US006704972B2

(12) United States Patent
Pyle

(10) Patent No.: US 6,704,972 B2
(45) Date of Patent: Mar. 16, 2004

(54) FASTENER ASSEMBLY

(75) Inventor: Kevin J. Pyle, Halstead, KS (US)

(73) Assignee: Cessna Aircraft Company, Wichita, KS (US)

( * ) Notice: Subject to any disclaimer, the term of this patent is extended or adjusted under 35 U.S.C. 154(b) by 0 days.

(21) Appl. No.: 10/192,298

(22) Filed: Jul. 10, 2002

(65) Prior Publication Data

US 2004/0006851 A1 Jan. 15, 2004

(51) Int. Cl.[7] ..... B65D 63/00

(52) U.S. Cl. ..... 24/16 PB; 24/17 AP; 24/30.5 P

(58) Field of Search ..... 24/16 R, 17 AP, 24/25, 20 CW, 20 EE, 20 TT, 16 PB, 30.5 R, 30.5 L, 30.5 P, 345, 346, 712.5, 156 R, 467, 657, 575, 578, 587; 403/392, 408.1, 340, 339; 292/307 R; 70/14, 15, 16

(56) References Cited

U.S. PATENT DOCUMENTS

| | | | | | |
|---|---|---|---|---|---|
| 69,120 | A | * | 9/1867 | Paine | 24/25 |
| 3,550,219 | A | * | 12/1970 | Van Buren | 248/73 |
| 3,819,139 | A | * | 6/1974 | Jemison | 248/73 |
| 4,071,023 | A | * | 1/1978 | Gregory | 128/878 |
| 4,340,996 | A | * | 7/1982 | Starace | 24/20 R |
| 4,572,466 | A | * | 2/1986 | Yamaguchi et al. | 248/73 |
| 4,617,702 | A | * | 10/1986 | Diederich, Jr. | 24/16 PB |
| 4,919,373 | A | * | 4/1990 | Caveney et al. | 248/74.3 |
| 5,088,158 | A | * | 2/1992 | Burkholder | 24/16 PB |
| 5,337,983 | A | * | 8/1994 | Mailey | 248/74.3 |
| 5,584,452 | A | * | 12/1996 | Koike | 248/74.3 |
| 5,651,376 | A | * | 7/1997 | Thompson | 128/878 |
| 5,657,516 | A | * | 8/1997 | Berg et al. | 24/452 |
| D389,051 | S | * | 1/1998 | Caveney et al. | D8/396 |
| 6,347,435 | B1 | * | 2/2002 | Davignon et al. | 24/16 PB |
| 6,507,979 | B1 | * | 1/2003 | Thompson | 24/16 PB |
| 6,516,498 | B2 | * | 2/2003 | LaCoy et al. | 24/16 R |
| 6,539,589 | B2 | * | 4/2003 | Thompson | 24/16 PB |
| 6,560,822 | B2 | * | 5/2003 | Caveney et al. | 24/16 PB |

* cited by examiner

*Primary Examiner*—Robert J. Sandy
*Assistant Examiner*—André L. Jackson
(74) *Attorney, Agent, or Firm*—Edward L. Brown, Jr.

(57) ABSTRACT

A lightweight plastic bolt-like fastener which is used in pairs having a dual ratcheting function. The fastener includes a bolt having a stem which is semi-cylindrical in cross-section, with a head connected to one end of the stem and a semi-circular aperture in the head positioned coaxially aligned with the stem for receipt of a stem from a second bolt directed in opposite orientation. Positioned longitudinally along the flat side of the stem is a rack of serrated teeth which when the stem is inserted within the semi-circular aperture, a deflectable locking tab attached to the head end of the stem engages the rack of serrated teeth as a ratchet, and since the two fasteners each have stems sliding within the semi-circular aperture of the opposing stem, there is a double ratcheting action between both fasteners.

6 Claims, 2 Drawing Sheets

FASTENER ASSEMBLY

BACKGROUND OF THE INVENTION

1. Field of the Invention

The field of invention relates to fastener structures and more particularly for a lightweight plastic fastener utilized in the aircraft industry which replaces a conventional bolt/screw-and-nut combination. Typically fasteners retain two or more elements together with a varying grip range. In aircraft applications it can be used to attach small diameter tube-clamps, guide blocks and cushion clamps. There are many applications where steel bolts/screws are structurally excessive and therefore overweight. The fastener of the present invention is installed with a squeezing or a push-pull motion rather than torsional rotation as used with conventional screws and bolts.

2. Description of the Prior Art

Plastic fasteners of various types have been well known in the prior art for a variety of different uses, such as binding a series of pages in a book-like form in a rapid manner, as typified in Tanaka, U.S. Pat. No. 5,074,696 which teaches a fastener used in binding pages:

Plastic wire tie fasteners are well known in the art which utilize a somewhat similar structure to the present invention to bind a bundle of wires. The flexible stem of the wire tie includes a longitudinal rack of serrated teeth that are pulled through an aperture having a deflectable locking tab which ratchets the teeth on the flexible stem to retain a bundle of wires together.

The patent to Vian, U.S. Pat. No. 3,938,587, illustrates a plastic tension fastener with a conventional male/female relationship between a bolt and nut which has a limited contact area between the latching teeth 26 on the nut and the cogs 30 on the bolt.

The patent to Sun et al, U.S. Pat. No. 4,730,972 teaches another fastener assembly for binding paper sheets in a conventional male/female relationship between the two binding parts 20 and 12 having mating teeth thereon which ratchet together.

SUMMARY OF THE INVENTION

The fastener of the present invention joins two or more elements together in a bolt like fashion whereby a pair of identical fasteners in opposed relationship are engaged together wherein the stem of one, which is semicircular in cross-section, is inserted through an aperture in the head of the other whereby a rack of serrated teeth on the inside flat surface of each stem is engaged by deflectable locking tabs attached to the opposite fastener. A dual ratcheting function is provided so each fastener engages and holds the stem of the other fastener so if one locking tab failed the fasteners would remain engaged to each other by reason of the locking tabs on the other fastener.

Once applicant's fastener has engaged what it is attempting to hold, the extending portions of the stem are cut off leaving a bolt like fastener custom sized to grip length with similar heads on opposite ends of the bolt. Due to the original length of the stem portions, the fastener has a variable grip length with a range between 0.05 inches and 1.75 inches. Larger sized fasteners could have greater grip lengths. The installation time with this fastener is very short due to the strictly lineal movement of the mating fasteners which can be engaged by either tensile action pulling the extending stems with a modified Panduit type wire tie gun.

Also a compression action can be used by forcing the two heads together A whereby the locking tabs on each fastener ratchet along the rack of serrated teeth of the opposing fastener so as to firmly grip the items being joined.

The plastic fasteners of the present invention are substantially lighter than conventional bolts or screws. Removal of the fastener of the present invention is quickly removed by merely cutting off one of the heads through the center of the head.

The fastener of the present invention is used in pairs which are engaged in opposite juxtaposed orientation to each other wherein the stems of each fastener are inserted through a semi-circular aperture in the head of the opposing fastener whereby locking tabs within each head engage the serrated teeth positioned longitudinally along the flat diameter surface of the stem of the other in a ratcheting manner with each fastener providing an engagement means with the other.

The previously mentioned patent to Tanaka is similar to the present invention in that it utilizes a pair of fasteners placed in opposite orientation to each other wherein a rack of serrated teeth positioned on the diameter surface of each fastener engages a similar series of serrated teeth on the opposite fastener to provide a bolt-like tension fastener assembly. The two identical fasteners are held in juxtaposed coaxial relation by means of a pair of rigid plates 18 and 19 which are separate and apart from the fasteners. The Tanaka fasteners can accommodate a varying grip range. However, it is limited in that the pair of fasteners cannon overlap past the head of the fastener, which is contrary to the present invention. Also, the two plates, which the Tanaka fasteners pass through, must have a relatively large tolerance fit since the unmeshed depth of the serrated teeth require a larger diameter hole.

It is therefore the principal object of the present invention to provide a variable grip range fastener used in pairs having a dual set of locking teeth.

A further object of the present invention is to provide a fastener with a smooth circular shank once assembled with its clearance hole.

Another object of the present invention is to provide a single size fastener which provides a variable grip length which can be trimmed to a tailored configuration:

Another object of the present invention is to provide a fastener with a quick installation time wherein the manner of engagement is either tensile action or compression of the heads of the two fasteners.

DESCRIPTION OF THE PREFERRED EMBODIMENT

Figure 3:
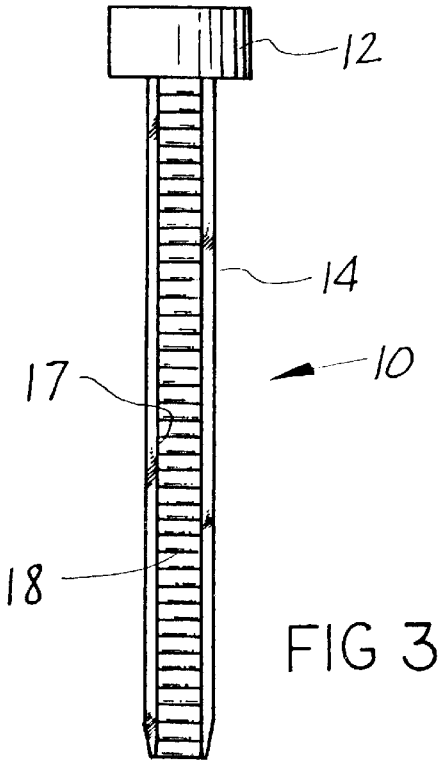
FIG. 3 is a side elevational view of the fastener.
Figure 2:
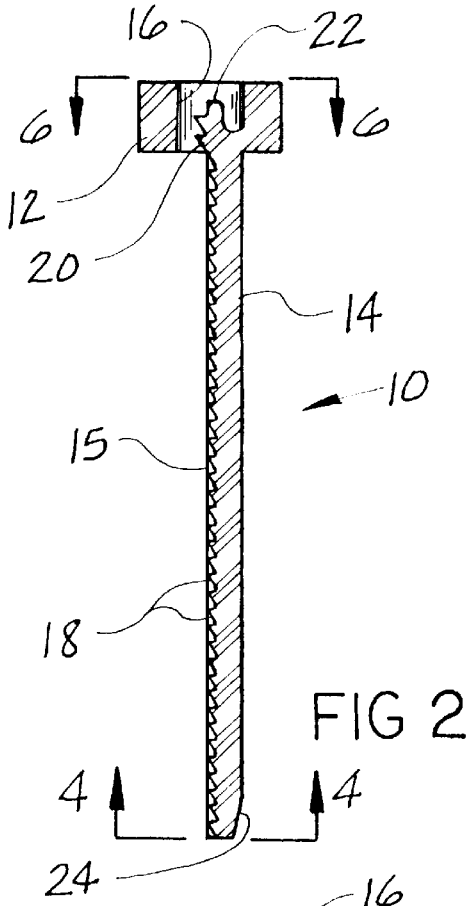
FIG. 2 is a side elevational view in longitudinal section of a single fastener.
Figure 4:
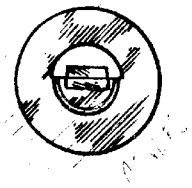
FIG. 4 is a stem end view of a single fastener taken along line 4—4 of FIG. 2.
Figure 4:
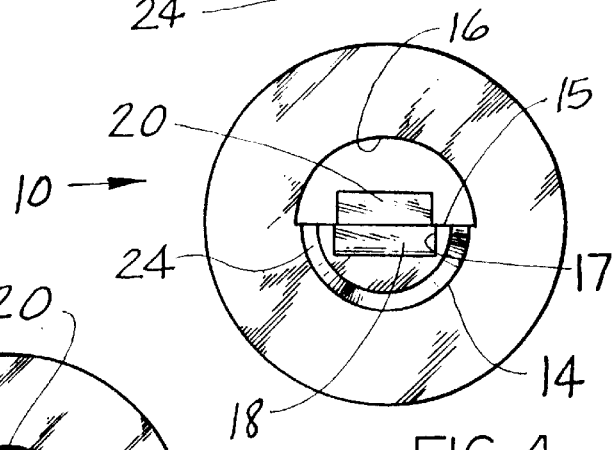

With reference now to the drawings, and in particular FIGS. 2, 3 and 4, the fastener of the present invention is generally designated by reference numeral 10.

Each fastener 10 comprises a semi-cylindrical stem 14 connected to a head 12. Each head 12 contains a semi-circular opening 16 for receipt of the stem 14 of a companion fastener. The opening 16 is coaxially aligned with the stem portion of its fastener whereby a pair of fasteners oppositely positioned to each other, each stem 14 can engage the opening 16 of the opposite fastener.

Located on the flat or diameter side 15 of each stem 14, is a channel 17 which has a recessed rack of serrated teeth 18 contained therein. The ends of the teeth 18 lie in the plane of the diameter side 15 of the stem.

Figure 5:
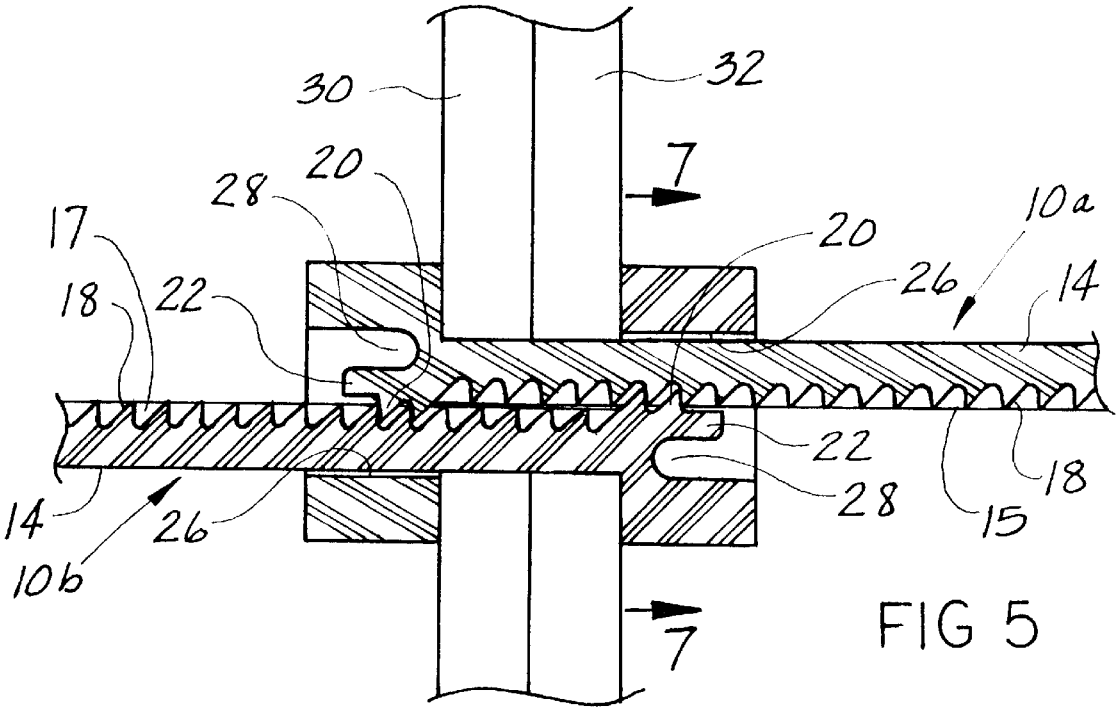
FIG. 5 is a longitudinal sectional view to an enlarged scale of a pair of fasteners tensionally gripping together two sheets of material with portions of the fastener stems broken away.
Figure 1:
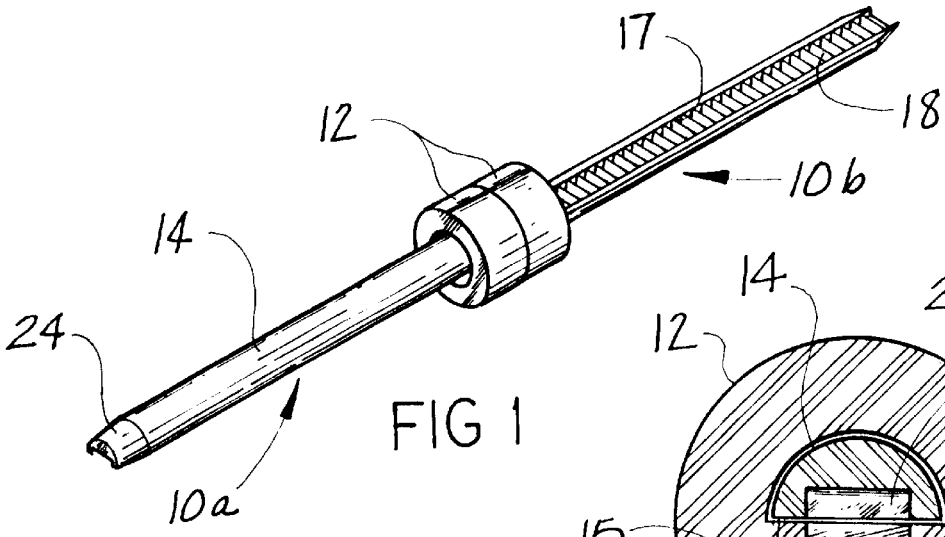
FIG. 1 is a perspective view of two of the fasteners engaging each other with their respective heads in contacting relation.
Figure 7:
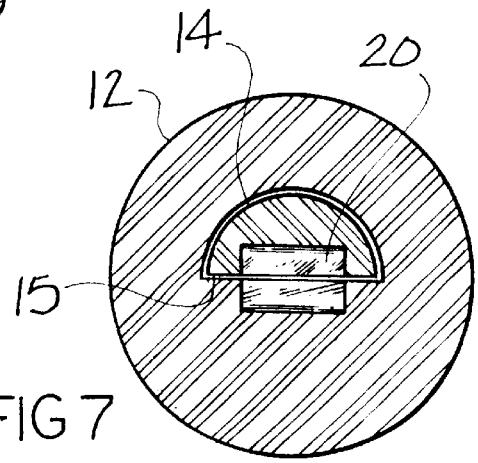
FIG. 7 is a sectional view taken along line 7—7 of FIG. 5.
Figure 6:
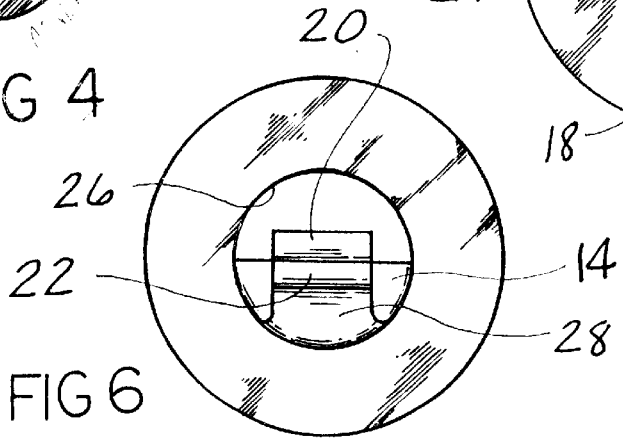
FIG. 6 is a head end view of a single fastener taken along line 6—6 of FIG. 2.

Located on the back side of head 12, as shown in FIGS. 5 and 6, is a circular opening 26 sized to receive the stem 14 of the opposing fastener 10 in juxtaposed contacting relation. Located within cylindrical opening 26 is an extension 22 of stem 14 which carries at least one locking tab 20, as best seen in FIG. 5, which extend past the diameter side 15 of its stem into engagement with the serrated teeth 18 recessed in juxtaposed stem 14. Extension 22 is cantilevered over an undercut area 28 thereby providing a degree of flexing so that tabs 20 can ratchet along rack 18. The free end of stem 14 includes a taper 24, as shown in FIG. 1, to assist in engaging opening 16 in its opposing fastener.

OPERATION

The tension fastener 10 of the present invention can be used to join two parts 30 and 32, as shown in FIG. 5, or any other multitude of objects. The stem of the first fastener 10*a* is inserted through a clearance hole of mating parts whereupon the second fastener 10*b* is aligned for receipt of its stem 14 in the opening 16 of stem 10*a* and similar receipt of stem 14 of fastener 10*b* in its semi-circular opening 16. Once one of the stems 14 of a fastener extends through the head of the opposing fastener, the locking tabs 20 will engage the rack of serrated teeth 18 on the opposing fastener and permit the fasteners 10*a* and 10*b* to be drawn together in a dual ratcheting fashion by the locking tabs 20 of both fasteners, 10*a* and 10*b*. The free ends of stems 14, as seen in FIG. 1, can be engaged and placed under tension to draw the pair of fasteners into tightened engagement. Since one side of the locking tab 20 is sloped at an angle while the opposing tooth surface is normal to the length of the stem, the engaging tabs 20 will ratchet in one direction and lock in the other. By reason of the undercut area 28 behind locking tabs 20, the tabs are free to deflect behind the diameter side 15 of its stem and ratchet along the rack of teeth 18. Once the pair of fasteners has engaged, whatever parts or surfaces they are joining, the racks of serrated teeth are blocked from view with the stems of the two fasteners in juxtaposed contacting relation with each other, providing a smooth surface round shank for its clearance hole. Once the fasteners have joined two elements together, the extending portions of each stem 14 from its opposing head can be cut off flush so as to provide a cylindrical head on both ends of the fastener assembly.

To remove the fasteners once engaged, a head 12 at one end is cut off which thereby releases the two joined stems 14 to pass through the clearance hole of the parts 30 and 32. Removal can also be accomplished by running a #40 drill bit down through the center of the fastener destroying the locking tabs 20 on both fasteners.

The foregoing is considered as illustrative only of the principals of the invention. Further, since numerous modifications and changes will readily occur, to those skilled in the art it is not desired to limit the invention to the exact construction as shown and described, and accordingly, all suitable modifications and equivalents may be resorted to which follows within the scope of the invention.

What is claimed is:

1. A lightweight plastic bolt fastener used in pairs to form a bolt with heads at both ends having a dual ratcheting function comprising:

a bolt having a stem which is semicircular in cross-section with a flat side thereon, and having a longitudinal axis;

a head connected to one end of the stem;

a semi-circular aperture in the head, positioned co-axially aligned with said axis of said stem for receipt of a like stem of a second bolt, the two stems together form a circular cross section;

a rack of serrated teeth positioned longitudinally along the flat side of said stem;

at least one deflectable locking tab attached to the head end of the stem, said locking tab extending partially into said semi-circular aperture for ratcheting locking engagement with a rack of serrated teeth from said second bolt when inserted into said semi-circular aperture.

2. A plastic bolt fastener, as set forth in claim 1, wherein the rack of serrated teeth is recessed within the flat side of said stem and the locking tabs are connected to the head in a cantilevered manner to allow deflection of the locking tabs, when a stem of a second bolt is inserted through said aperture.

3. A plastic bolt fastener, as set forth in claim 1, wherein the locking tab is connected to the head in a cantilevered manner with a cutout area of the head behind the tab.

4. A plastic bolt fastener, as set forth in claim 1, wherein there are a plurality of locking tabs which have a similar longitudinal cross-section as the rack of serrated teeth and the locking tabs are connected to the head in a cantilevered manner so as to allow lateral deflection of the locking tabs.

5. A plastic bolt fastener, as set forth in claim 1, wherein the locking tabs extend out of the plane of said flat side of the stem.

6. A lightweight plastic bolt fastener used in pairs to form a bolt with heads at both ends, each fastener pair comprising:

a first and second bolt, each having a stem with a longitudinal axis which in cross-section has a flat side thereon;

a head connected to one end of each stem;

an aperture in each head having a similar cross-section and flat side thereon, positioned concentrically aligned with said axis of said stem for receipt of the other stem of the second bolt;

a rack of serrated teeth located longitudinally along the flat side of said stem of each bolt;

at least one deflectable locking tab on the head end of the first stem, said locking tab is positioned for ratcheting in locking engagement with said rack of serrated teeth from said second bolt when inserted into said aperture.

* * * * *